US008695759B1

(12) United States Patent
Michael

(10) Patent No.: US 8,695,759 B1
(45) Date of Patent: Apr. 15, 2014

(54) APPARATUS AND METHOD FOR SAFELY LOWERING USER FROM STRUCTURE WITH TRACK-ACTUATED HYDRAULIC BRAKES

(71) Applicant: Ralph L. Michael, Lake Forest, CA (US)

(72) Inventor: Ralph L. Michael, Lake Forest, CA (US)

( * ) Notice: Subject to any disclaimer, the term of this patent is extended or adjusted under 35 U.S.C. 154(b) by 0 days.

(21) Appl. No.: 13/840,041

(22) Filed: Mar. 15, 2013

(51) Int. Cl.
*A62B 1/00* (2006.01)

(52) U.S. Cl.
USPC ..... 182/82; 472/131; 188/38; 188/41; 182/19; 182/141

(58) Field of Classification Search
USPC ..... 182/19, 36, 37, 80, 48, 141; 472/2, 38, 472/43, 50, 59, 131; 188/38, 41, 43, 62, 188/72.5, 73.2
See application file for complete search history.

(56) References Cited

U.S. PATENT DOCUMENTS 4,125,172 A * 11/1978 Hatala ..... 182/19
4,865,155 A * 9/1989 Montaigne et al. ..... 182/14
5,628,690 A * 5/1997 Spieldiener et al. ..... 472/131
6,083,111 A * 7/2000 Moser et al. ..... 472/50
6,126,550 A * 10/2000 Moser et al. ..... 472/50
6,523,318 B2 * 2/2003 Carmel ..... 52/650.1
6,817,443 B1 * 11/2004 Metz ..... 182/82
7,096,996 B2 * 8/2006 Korchagin et al. ..... 182/82
7,204,344 B2 * 4/2007 Korchagin et al. ..... 182/82
8,061,343 B2 * 11/2011 Kamen et al. ..... 124/71
8,141,681 B2 * 3/2012 Brickell et al. ..... 182/37
8,151,941 B2 * 4/2012 Moses et al. ..... 187/239
8,210,311 B1 * 7/2012 Rice ..... 182/9
2009/0139797 A1 * 6/2009 Rastegar et al. ..... 182/5
2013/0019771 A1 * 1/2013 Gmeinwieser et al. ..... 104/53

* cited by examiner

*Primary Examiner* — Katherine Mitchell
*Assistant Examiner* — Daniel Cahn
(74) *Attorney, Agent, or Firm* — Fountain Law Group, Inc.; George L. Fountain

(57) ABSTRACT

An apparatus is disclosed for safely lowering a user from a structure. The apparatus includes a user support component upon which the user is supported while being safely lowered from the structure. The apparatus includes a brake system that has two hydraulic brakes configured to apply first and second defined pressures on a brake pad against a track situated proximate the structure. The track is configured not to activate the first and second hydraulic brakes at an upper vertical section of the track to allow the apparatus to descend with a positive acceleration; activate only the first hydraulic brake at a middle vertical section of the track to allow the apparatus to descend with a substantially constant velocity; and activate only the second hydraulic brake at a lower vertical section of the track to allow the apparatus to descend with a negative acceleration.

13 Claims, 8 Drawing Sheets

APPARATUS AND METHOD FOR SAFELY LOWERING USER FROM STRUCTURE WITH TRACK-ACTUATED HYDRAULIC BRAKES

FIELD

This disclosure relates generally to emergency and safety devices, and in particular, to an apparatus and method for safely lowering a user from a structure with track-actuated hydraulic brakes.

BACKGROUND

Residential and commercial buildings are often equipped with many safety features in order to deal with emergency situations. For instance, buildings often include smoke detectors and alarms adapted to alert people of an on-going fire to allow them to take safety measures, such as exiting a building in a safe manner. Additionally, many buildings include a network of fire extinguishers and fire-protected stairwells to protect those from harm due to fire and smoke. Often, these measures of alerting and protecting building dwellers are sufficient.

On occasion, a building may be damaged in such a way as to prevent the safe egress from the building. For example, the stairwell or exit corridor may be consumed with smoke or fire. Similarly, the exit path may be blocked due to earthquake damage. For people in a single story building or on the first or perhaps the second floor of a building, this may not be a problem because people may, to some degree, safely exit the structure through a window or door.

In situations that involve a multi-level or high-rise building, this situation of a blocked egress in the building may present a difficult or dire problem for the habitants. If, for example, some of those people are present at the lower seventh floors of a building, a fire truck ladder may be used to reach them, and bring them down in a safe manner. This is assuming that those people are able to wait out the emergency until a fire truck arrives. This may not always be the case.

In cases where building dwellers are above the seventh floor, other means, perhaps a rescue helicopter may be needed to safely remove those inside the building. This may not always be possible, as in the case of the 9/11 New York City's twin tower disaster. Not only are the building dwellers susceptible to this kind of adverse situation, but fire fighters as well may get trapped in a multi-level building with no easy course-of-action to safely exit the structure. Thus, there is a need for an apparatus to facilitate a safe egress from a multi-level or high-rise building or structure.

SUMMARY

An aspect of the disclosure relates to an apparatus for safely lowering a user from a structure. The apparatus includes a user support component upon which the user is supported while being safely lowered from the structure. The apparatus includes a brake system that has two hydraulic brakes configured to apply first and second defined pressures on a brake pad against a track situated proximate the structure. The track is configured not to activate the first and second hydraulic brakes at an upper section of the track to allow the apparatus to descend with a positive acceleration. The track is configured to activate only the first hydraulic brake at a mid-section of the track to allow the apparatus to descend with a substantially constant velocity. And, the track is configured to activate only the second hydraulic brake at a lower section of the track to allow the apparatus to descend with a negative acceleration. The pressure exerted on the brake pad by the second hydraulic brake is greater than the pressure exerted on the brake pad by the first hydraulic brake.

In another aspect of the disclosure, the pressure applied by the first and second hydraulic brakes upon the brake pad is derived from the weight of the user support component on first and second pistons associated with the first and second hydraulic brakes, respectively. In particular, the first and second hydraulic brakes include first and second sliders for selectively coupling first and second portions of the user support component to first and second pistons configured to exert pressure on hydraulic fluid contained in first and second cylinders associated with the first and second hydraulic brakes, respectively.

After the apparatus has descended a first defined distance with a positive acceleration, a first portion of the track moves the first slider into a position where it couples the first portion of the user support component to the first piston of the first hydraulic cylinder. Thus, the weight of the user support component upon the first slider is transferred to the first hydraulic cylinder by way of the first piston. In response, the fluid in the first hydraulic cylinder exerts pressure on the brake pad against the track to cause the apparatus to descend with a substantially constant velocity.

After the apparatus has descended a second defined distance with a substantially constant velocity, a second portion of the track moves the second slider into a position where it couples the second portion of the user support component to the second piston of the second hydraulic cylinder. Thus, the weight of the user support component upon the second slider is transferred to the second hydraulic cylinder by way of the second piston. In response, the fluid in the second hydraulic cylinder exerts pressure on the brake pad against the track to cause the apparatus to descend with a negative acceleration. The track includes a stop component configured to stop the apparatus from further descending, and allow the user to step off safely to ground or a landing platform. The bottom of the track is spaced apart from the stop component to allow the apparatus to slide off the track.

The second hydraulic brake may be configured to exert a pressure on the brake pad that is greater than the pressure exerted on the brake pad by the first hydraulic brake. For example, this may be accomplished by configuring the second hydraulic cylinder associated with the second hydraulic brake with a smaller cross-sectional area than the cross-sectional area of the first hydraulic cylinder associated with the first hydraulic brake. For instance, the second hydraulic cylinder may be configured with a diameter smaller than the diameter in which the first hydraulic cylinder is configured.

Additionally, the second hydraulic brake may be configured to substantially, or to a defined degree, disengage the first hydraulic brake. For instance, the second slider associated with the second hydraulic brake may be configured to have a thickness greater than the first slider associated with the first hydraulic brake. Because the second slider is thicker than the first slider, when the second slider moves into the activated position, it raises the user support component so that it no longer, or without much force, contacts the first slider. This reduces the force of the user support component on the first slider. This in effect reduces the pressure exerted on the brake pad by the first hydraulic brake.

Other aspects, advantages and novel features of the present disclosure will become apparent from the following detailed description of the disclosure when considered in conjunction with the accompanying drawings.

DETAILED DESCRIPTION OF THE EXEMPLARY EMBODIMENTS

Figure 1A:
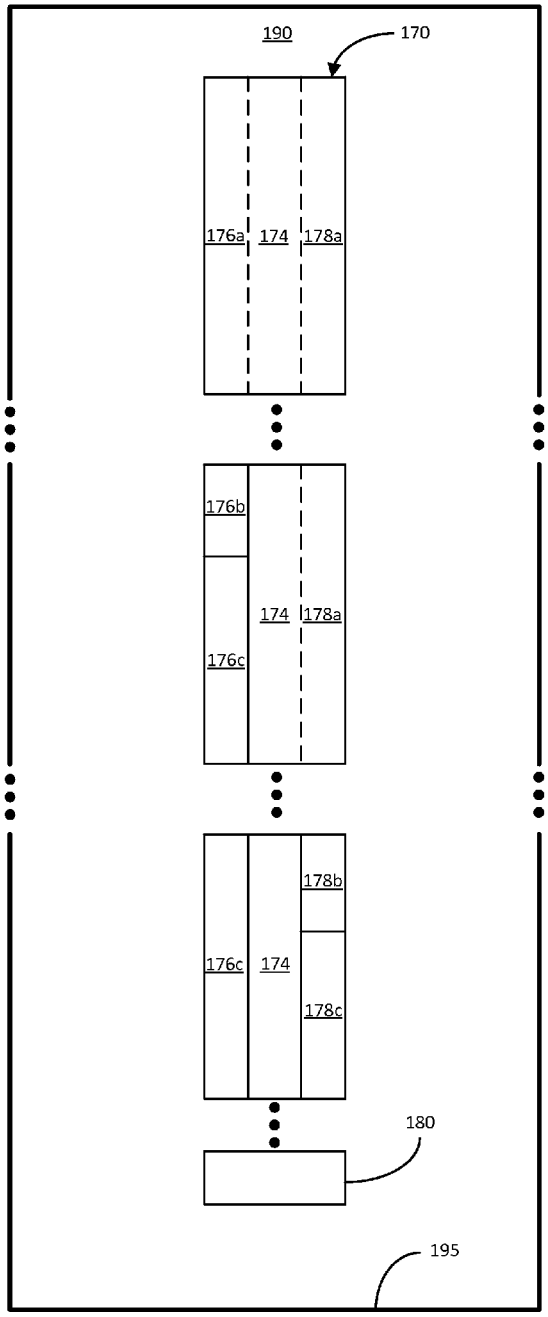
FIGS. 1A-1B illustrate front and side views of an exemplary track associated with an exemplary apparatus for safely lowering a user from a structure in accordance with an aspect of the disclosure.
Figure 1B:
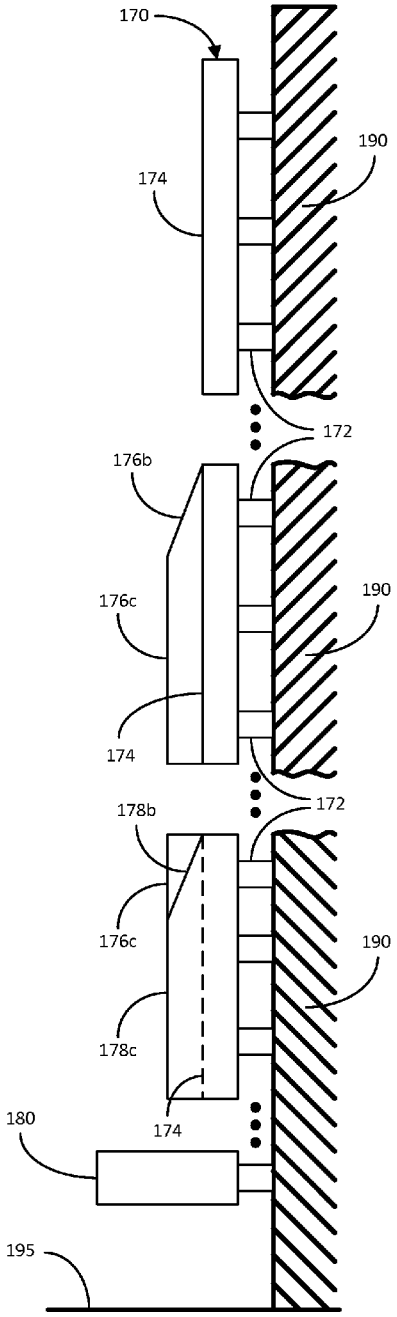

FIGS. 1A-1B illustrate front and side views of an exemplary track 170 associated with an exemplary apparatus for safely lowering a user from a structure 190 in accordance with an aspect of the disclosure. The structure 190 may be any type of structure, such as a commercial or residential building. The track 170 is oriented substantially vertical and positioned adjacent to a substantially vertical face or wall of the structure 190. Although the track 170 and face or wall of the structure 190 are described as being substantially vertical, it shall be understood that they may be inclined depending on the angle of inclination of the face or wall of the structure 190, as in the case of a pyramid-like structure.

The track 170 comprises a plurality of mounts 172 for securely attaching the track 170 to the vertical face or wall of the structure 190. It shall be understood that the track 170 need not be coupled to the structure 190, but may be supported vertically by other means. The track 170 further comprises a first vertical surface 174 for making frictional contact with a brake pad of an apparatus for safely lowering a user from the structure 190, as discussed in more detail herein. In this example, the first vertical surface 174 extends substantially the full height of the track 170 along a central portion of the track 170.

The track 170 is divided up into three vertical sections. As discussed in more detail herein, the top vertical section is configured to allow the user lowering apparatus to descend with a positive vertical acceleration. The middle vertical section is configured to allow the user lowering apparatus to descend at substantially no vertical acceleration (e.g., at a substantially constant velocity). The bottom vertical section is configured to allow the user lowering apparatus to descend with a negative vertical acceleration to a complete stop. As discussed above, the first vertical surface 174 against which the brake pad of the apparatus slides extends from the top vertical section to the bottom vertical section of the track 170, and terminates at a stop 180.

The track 170 also includes a second generally vertical surface, which is partitioned into three sections 176*a*, 176*b*, and 176*c*. The second vertical surface 176*a-c* extends from the top vertical section to the bottom vertical section of the track 170, substantially parallel with and positioned to the left of the first vertical surface 174. In the top vertical section of the track 170, the section 176*a* of the second vertical surface is substantially planar with the first vertical surface 174. In the middle vertical section of the track 170, the section 176*b* is inclined from the vertical toward the horizontal in a direction away from the structure 190 along a descending path of the section 176*b*. The inclined or ramped section 176*b* leads to the substantially vertical section 176*c*, which extends from the middle vertical section to the bottom vertical section of the track 170 and terminates at the stop 180.

As discussed further herein, the section 176*a* of the second vertical surface does not cause an activation of a first hydraulic brake of the user lowering apparatus. The inclined or ramped section 176*b* of the second vertical surface causes the first hydraulic brake of the user lowering apparatus to transition from the deactivated state to an activated state. The section 176*c* of the second vertical surface maintains the first hydraulic brake of the user lowering apparatus in the activated state, until the second hydraulic brake disengages or reduces the effectiveness of the first hydraulic brake, as discussed further herein.

Similarly, the track 170 also includes a third generally vertical surface, which is partitioned into three sections 178*a*, 178*b*, and 178*c*. The third vertical surface 178*a-c* extends from the top vertical section to the bottom vertical section of the track 170, substantially parallel with and positioned to the right of the first vertical surface 174. In the top and middle vertical sections of the track 170, the section 178*a* of the third vertical surface is substantially planar with the first vertical surface 174. In the bottom vertical section of the track 170, the section 178*b* is inclined from the vertical toward the horizontal in a direction away from the structure 190 along a descending path of the section 178*b*. The inclined or ramped section 178*b* leads to the substantially vertical section 178*c*, which extends along the bottom vertical section of the track 170 and terminates at the stop 180.

As discussed further herein, the section 178*a* of the third vertical surface does not cause an activation of a second hydraulic brake of the user lowering apparatus. The inclined or ramped section 178*b* of the third vertical surface causes the second hydraulic brake of the user lowering apparatus to transition from the deactivated state to an activated state. The section 178*c* of the third vertical surface maintains the second hydraulic brake of the user lowering apparatus in the activated state. The stop 180 prevents the user lowering apparatus from descending any further, and is situated near the ground or a landing platform 195, upon which the user may disembark from the apparatus.

Figure 2A:
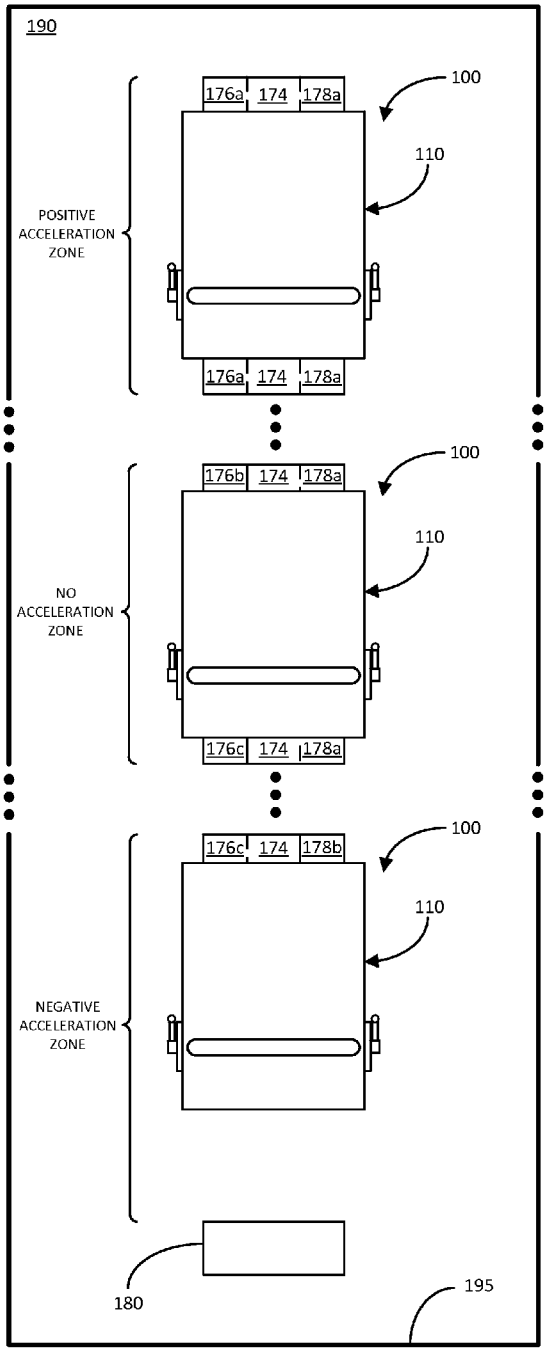
FIGS. 2A-2B illustrate front and side views of an exemplary apparatus for safely lowering a user from a structure in accordance with another aspect of the disclosure.
Figure 2B:
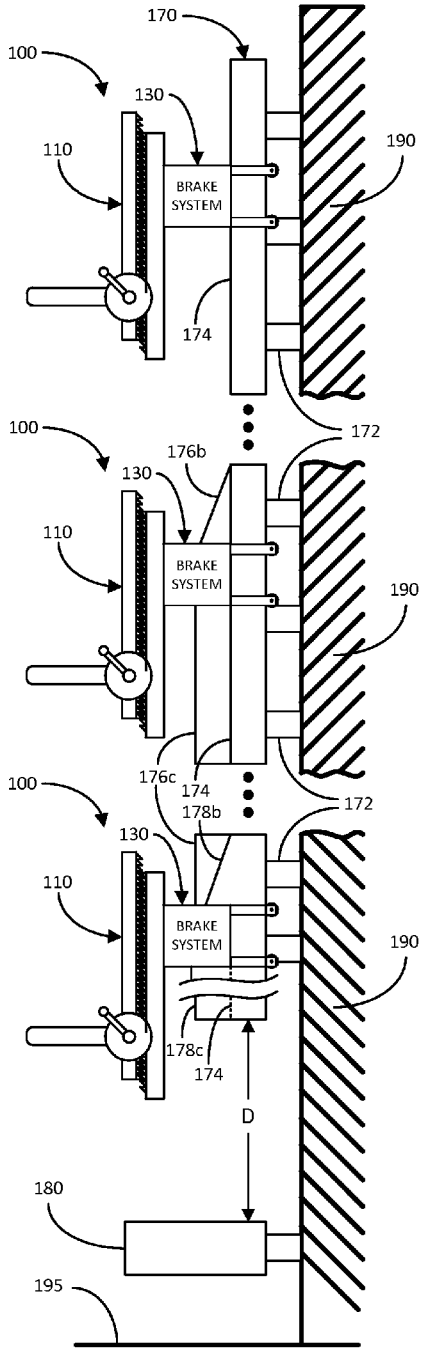

FIGS. 2A-2B illustrate front and side views of an exemplary apparatus 100 for safely lowering a user from the structure 190 in accordance with another aspect of the disclosure. As illustrated, the apparatus 100 comprises a user support component 110 coupled to a brake component 130. The brake component or system 130 is configured to ride along the track 170 from the top vertical section to the bottom vertical section. As previously discussed, the top vertical section of the track 170 is configured to allow the apparatus 100 to descend with a positive acceleration; the middle vertical section of the track 170 is configured to allow the apparatus 100 to descend at substantially zero (0) acceleration (e.g., substantially constant velocity); and the bottom vertical section of the track 170 is configured to allow the apparatus 100 to descend with a negative acceleration, until it is completely stopped by the stop component 180 of the track 170.

To effectuate the different accelerations for the apparatus 100 at the different vertical sections or zones of the track 170, the second and third vertical surfaces 176*a-c* and 178*a-c* are configured to interact with the brake system 130 of the apparatus 100. In particular, at the top vertical section of the track 170, where the track is configured to allow the apparatus 100 to descend with a positive vertical acceleration (e.g., at substantially free fall acceleration), the sections 176*a* and 178*a* of the second and third vertical surfaces do not activate the first and second hydraulic brakes of the brake system 130.

As the apparatus 100 descends into the middle vertical section of the track 170, the inclined or ramp section 176*b* of the second vertical surface of the track 170 transitions the first hydraulic brake of the brake system 130 from a deactivated state to an activated state. The following substantially vertical section 176*c* of the second vertical surface of the track 170 maintains the first hydraulic brake of the brake system 130 in the activated state while the apparatus 100 descends through the middle vertical section of the track 170. The section 178*a* of the third vertical surface of the track 170 continues to maintain the second brake of the brake system 130 in a deactivated state while the apparatus 100 descends through the middle vertical section of the track 170. The activation of the first hydraulic brake of the brake system 130 causes the apparatus 100 to decelerate so that it is no longer descending with a positive acceleration, but rather with substantially zero acceleration or at a substantially constant velocity.

As the apparatus 100 descends into the bottom vertical section of the track 170, the inclined or ramp section 178*b* of the third vertical surface of the track 170 transitions the second hydraulic brake of the brake system 130 from a deactivated state to an activated state. The following substantially vertical section 178*c* of the third vertical surface of the track 170 maintains the second hydraulic brake of the brake system 130 in the activated state while the apparatus 100 descends through the bottom vertical section of the track 170. As discussed in more detail further herein, the activation of the second hydraulic brake of the brake system 130 causes the first hydraulic brake to be deactivated. The second hydraulic brake provides increased braking over the first hydraulic brake, and consequently causes the apparatus 100 to decelerate so that it descends with a negative acceleration through the bottom vertical section of the track 170. The apparatus 100 is subsequently stopped when it encounters the stop component 180 of the track 170 at a safe speed for the user. The user may then disembark from the apparatus 100 onto ground or the landing platform 195. The stop component 180 is spaced apart from the bottom of the track by a distance D. This distance D is provided to allow the apparatus 100, and in particular, the brake system 130 to slide off the bottom of the track 170.

Figure 3A:
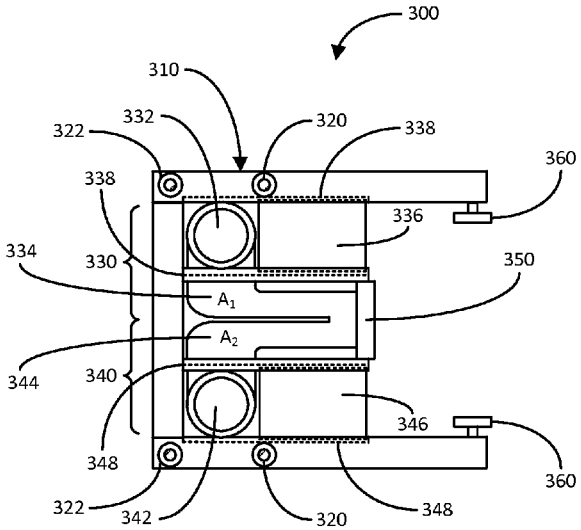
FIGS. 3A-3C illustrate top, side, and rear views of an exemplary brake system associated with the exemplary apparatus for safely lowering a user from a structure in accordance with another aspect of the disclosure.
Figure 3B:
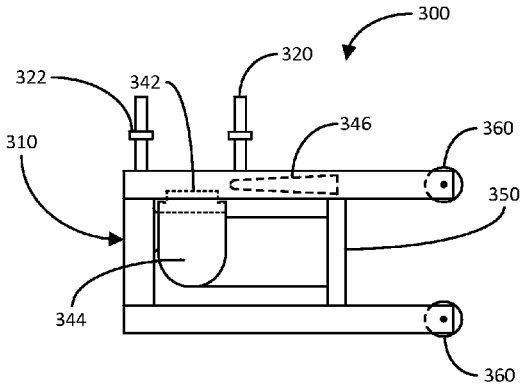
Figure 3C:
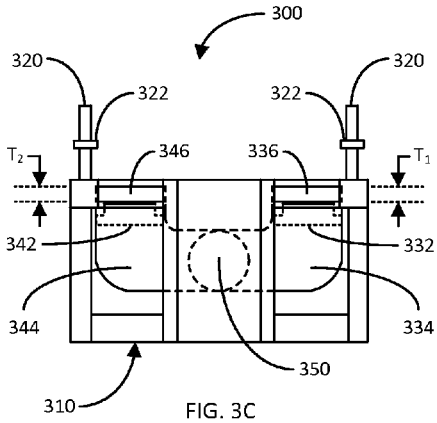

FIGS. 3A-3C illustrate top, side, and rear views of an exemplary brake system 300 in accordance with another aspect of the disclosure. The brake system 300 may be an exemplary detailed implementation of the brake system 130 of the apparatus 100, previously discussed. In particular, the brake system 300 comprises a frame 310 on which the remaining components of the brake system are mounted. The brake system 300 further comprises a first hydraulic brake 330 including a first piston 332, and a first hydraulic cylinder 334 filled with hydraulic fluid. The brake system 300 further comprises a second hydraulic brake 340 including a second piston 342, and a second hydraulic cylinder 344 filled with hydraulic fluid.

Although the cylinders 340 and 344 exemplified herein have circular cross-sections, it shall be understood that they may have different shape cross-sections. Additionally, the first hydraulic cylinder 334 is configured to have a first cross-sectional area $A_1$ and the second hydraulic cylinder 344 is configured to have a second cross-sectional area $A_2$, wherein the first cross-sectional area $A_1$ is greater than the second cross-sectional area $A_2$. This is done to configure the second hydraulic brake 340 to apply hydraulic pressure greater than the hydraulic pressure applied by the first hydraulic brake 330, as discussed in more detail further herein.

The brake system 300 further comprises a first slider 336 associated with the first hydraulic brake 330. In particular, the first slider 336 is configured to activate the first hydraulic brake 330 when moved from a first position to a second position by the inclined or ramped section 176*b* of the second vertical surface of the track 170, as previously discussed. More specifically, when the first hydraulic brake 330 is in a deactivated state, the first slider 336 is in a first position not situated directly above and in contact with the first piston 332. When the first hydraulic brake 330 is being activated, the first slider 336 is moved, by the inclined or ramped section 176*b* of the second vertical surface of the track 170, from the first position to a second position, along a guide 338 formed within the frame 310. In the second position, the first slider 336 is situated directly above and in contact with the first piston 332.

As discussed in more detail further herein, a first protrusion of the user support component of the apparatus 100 is situated directly above and spaced apart from the first piston 332 of the first hydraulic brake 330. While the first slider 336 is in the first or deactivated position (not situated between the first protrusion and the first piston 332), the first protrusion is not mechanically coupled to the first piston 332. When the first slider 336 is moved into the second or activated position (sandwiched between the first protrusion and the first piston 332), the weight of the user support component is transferred to the first piston 332. As a result, the first piston 332 exerts pressure on the hydraulic fluid contained in the first cylinder 334.

The first hydraulic cylinder 334 is coupled to a brake pad 350. The brake pad 350 makes frictional contact with the first vertical surface 174 of the track 170. Thus, when the first slider 336 is in the activated position, the weight of the user support component is transformed into hydraulic pressure against the brake pad 350 via the first slider 336 and the first piston 332. The pressure pushes the brake pad 350 against the first vertical surface 174 of the track 170. As a result, the friction between the brake pad 350 and the first vertical surface 174 increases to cause the apparatus 100 to decelerate from a positive descent acceleration to substantially no acceleration (e.g., a substantially constant velocity).

The operation of the second hydraulic brake 340 works in a similar fashion as the first hydraulic brake 330. In particular, the brake system 300 further comprises a second slider 346 configured to slide along a guide 348 formed within the frame 310 of the brake system 300. When the second slider 346 is in a first or deactivated position (not situated directly above and in contact with the second slider 346), the second slider 346 is not able to transfer or couple the weight of the user support component to the second piston 342. Consequently, the second piston 342 does not apply much pressure on the fluid in the second hydraulic cylinder 344. Consequently, little to no pressure is exerted on the brake pad 350 by the second hydraulic brake 340.

When the second slider 346 is moved into a second or activated position (sandwiched between the second protrusion of the user support component and the second piston 342) by the inclined or ramped section 178*b* of the third vertical surface of the track 170, the second slider 346 is able to transfer or couple the weight of the user support component to the second piston 342. In response to the transferred force, the fluid in the second hydraulic cylinder 344 applies pressure on the brake pad 350 against the first vertical surface 174 of the track 170. Because the second hydraulic cylinder 344 is configured to have a smaller cross-sectional area $A_2$, the fluid contained therein is capable of applying greater pressure on the brake pad 350. As a result, the friction is increased between the brake pad 350 and the first vertical surface 174, which causes the apparatus 100 to descend with a negative acceleration. The apparatus 100 subsequently stops when it encounters the stop component of the track 170.

The second hydraulic brake 340 is configured to deactivate the first hydraulic brake 330 when the second hydraulic brake 340 is activated. This is done by configuring the thickness $T_1$ of the first slider 336 to be less than the thickness $T_2$ of the second slider 346. More specifically, when the first slider 336 is moved into the activated position, the first slider 336 causes the user support component to move vertically upwards as a function of the thickness $T_1$ of the first slider 336. When the second slider 346 is moved into the activated position, the second slider 346 causes the user support component to move vertically upwards as a function of the difference between the thickness $T_2$ of the second slider 346 and the thickness $T_1$ of the first slider 336. The additional upward movement of the user support component substantially reduces the weight of the user support component on the first slider 336 so that the pressure exerted by the fluid in the first hydraulic cylinder 334 on the brake pad 350 is reduced.

The brake system 300 further comprises a plurality of alignment rods 320 (e.g., four rods) extending vertically above the frame 310. When the user support component is mounted on the brake system 300, the alignment rods are inserted through corresponding alignment holes of the user support component, as discussed further herein. Additionally, the brake system 300 comprises a plurality of stops 322 coaxially mounted around the alignment rods 320, respectively. As discussed further herein, the stops 322 prevent the first and second protrusions of the user support component from contacting the first and second pistons 332 and 342, when the user support component is mounted on the brake system 330. Additionally, the brake system 300 also comprises a plurality of wheels 360 rotatably coupled to the frame 310. The wheels 360 are configured to roll on a rear surface of the track 170 while the apparatus 100 is descending, as discussed further herein.

Figure 4A:
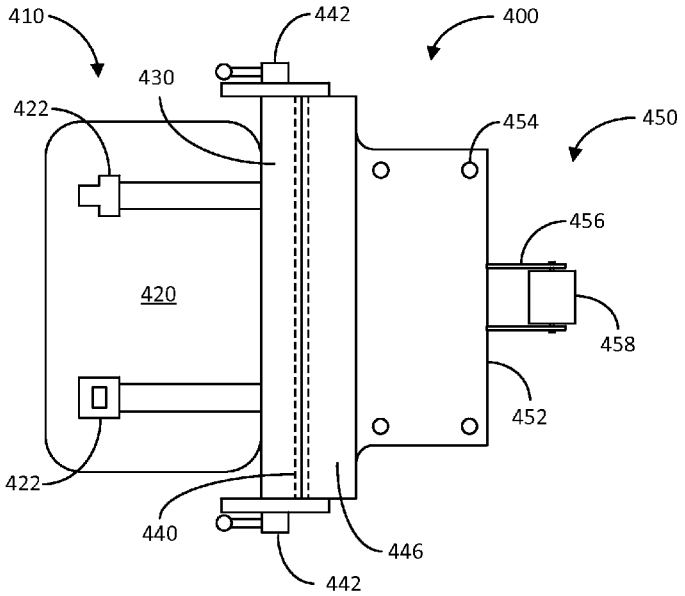
FIGS. 4A-4C illustrate top, side, and rear views of an exemplary user support component associated with the exemplary apparatus for safely lowering a user from a structure in accordance with another aspect of the disclosure.
Figure 4B:
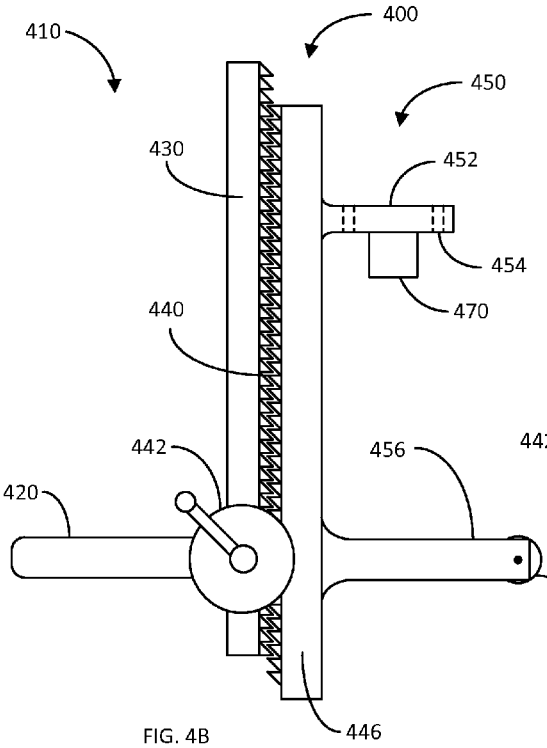
Figure 4C:
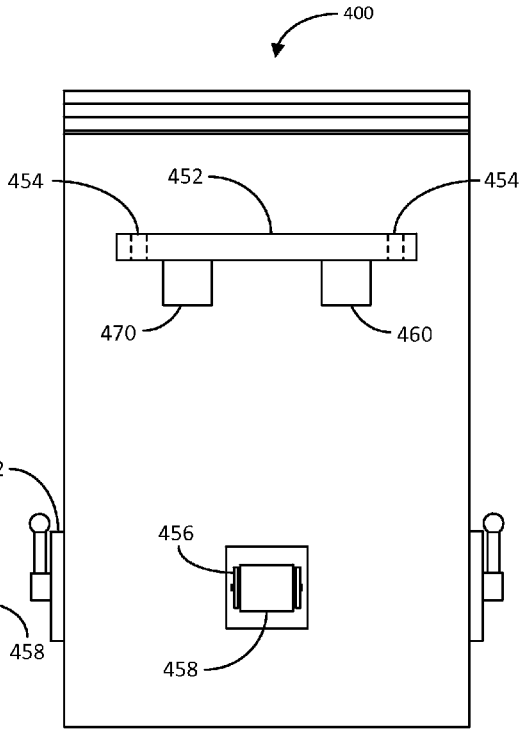

FIGS. 4A-4C illustrate top, side, and rear views of an exemplary user support component 400 in accordance with another aspect of the disclosure. The user support component 400 may be a detailed implementation of the user support component 110 of the apparatus 100, previously discussed. The user support component 400 comprises a user support subassembly 410 and a brake system interface 450. The user support subassembly 410 comprises a vertically-oriented back support 430 securely coupled to a horizontally-oriented seat 420. The user support subassembly 410 further comprises a seat belt 422 for securely maintaining a user on the seat 420 while the apparatus 100 is descending.

The vertically-oriented back support 430 is coupled to another vertically-oriented member 446 by way of a ratchet interface 440. The user support component 400 may further comprise a lever 442 for adjusting the vertical position of the back support 430 with respect to the vertical member 446. The reason for this is to accommodate users of different heights. That is, when the apparatus 100 reaches the bottom of the track 170, the bottom of the vertical member 446 lands on the stop component 180 of the track 170. At that position, the seat 420 is a certain distance above the ground or landing platform 195 depending on the vertical position of the back support 430 with respect to the vertical member 446. To prevent the feet of a user from striking the ground or landing platform 195 when the apparatus 100 reaches the bottom of the track 170, or to allow a user to easily get off the seat 420 and onto the ground or landing platform 195, the ratchet interface 440 including the level 442 allows the user to set the desired distance between the seat 420 and ground or the landing platform 195 when the apparatus 100 reaches the bottom of the track 170.

The brake system interface 450 of the user support component 400 comprises a substantially horizontal member 452 securely attached to the vertical member 446. The horizontal member 452 comprises a plurality of alignment holes 454 (e.g., four holes) extending vertically through the member 452. When the user support component 400 is mounted on the brake system 300, the alignment holes 454 receive the alignment rods 320 of the brake system 300 from below and therethrough. The bottom of the horizontal member 452 is configured to rest on the stops 322 when the user support component 400 is mounted on the brake system 300.

The brake system interface 450 further comprises first and second protrusions 460 and 470 securely attached to and vertically extending below the horizontal member 452. The first and second protrusions 460 and 470 operate as the first and second weights to apply pressure or force on the first and second pistons 332 and 342 by way of the first and second sliders 336 and 346, respectively. Additionally, the user support component 400 comprises a track interface including an arm 456 and a wheel 458. The arm 456 is securely coupled to the vertical member 446 at one end, and the wheel 458 is rotatably coupled to the other end. As further discussed herein, the wheel rolls along the first vertical surface 174 of the track 170 when the apparatus 100 is descending. The track interface is configured to relieve torque tension of the horizontal member 452 against the alignment rods 320.

Figure 5A:
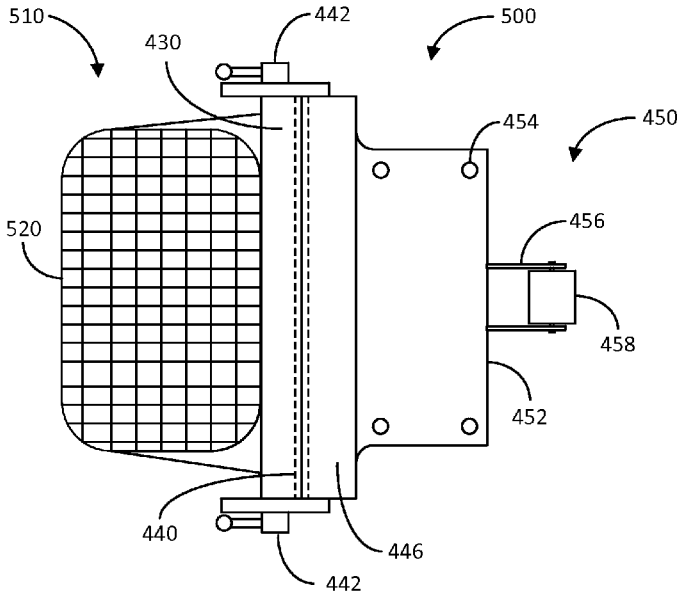
FIGS. 5A-5C illustrate top, side, and rear views of another exemplary user support component associated with the exemplary apparatus for safely lowering a user from a structure in accordance with another aspect of the disclosure.
Figure 5B:
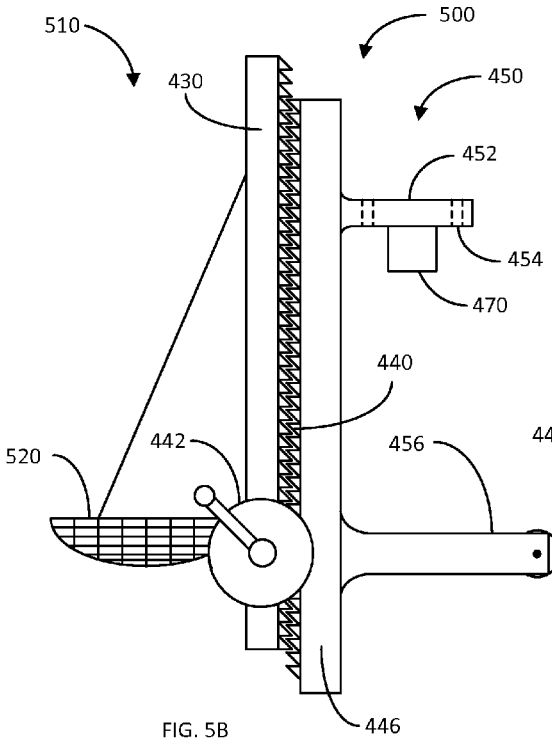
Figure 5C:
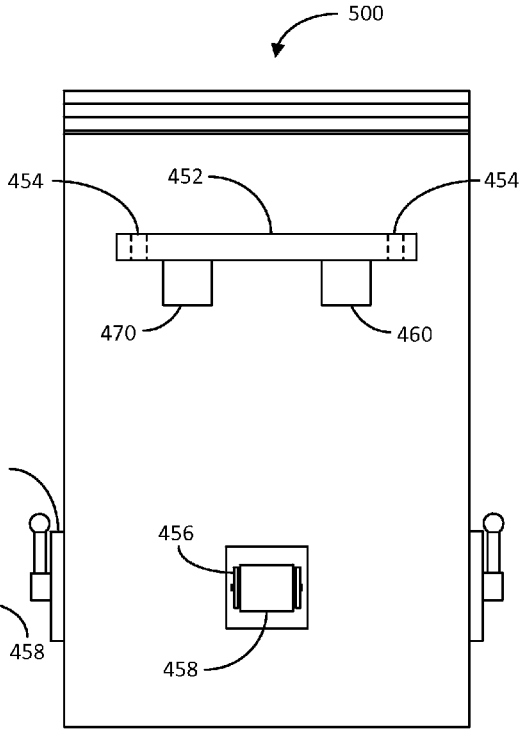

FIGS. 5A-5C illustrate top, side, and rear views of another exemplary user support component 500 in accordance with another aspect of the disclosure. The user support component 500 is similar to that of user support component 400 previously discussed, and includes many of the same elements as indicated by the same reference numbers. The user support component 500 differs from user support component 400 in that it comprises a different user support subassembly 510. In particular, the user support subassembly 510 includes a net-like structure 520 upon which a user may sit. The net-like structure 520 may be more advantageous than the seat 420, since it may better accommodate people of different sizes. It shall be understood that there may be other ways to support a user on the user support component 500, including harnesses, step, hand rails, etc.

Figure 6A:
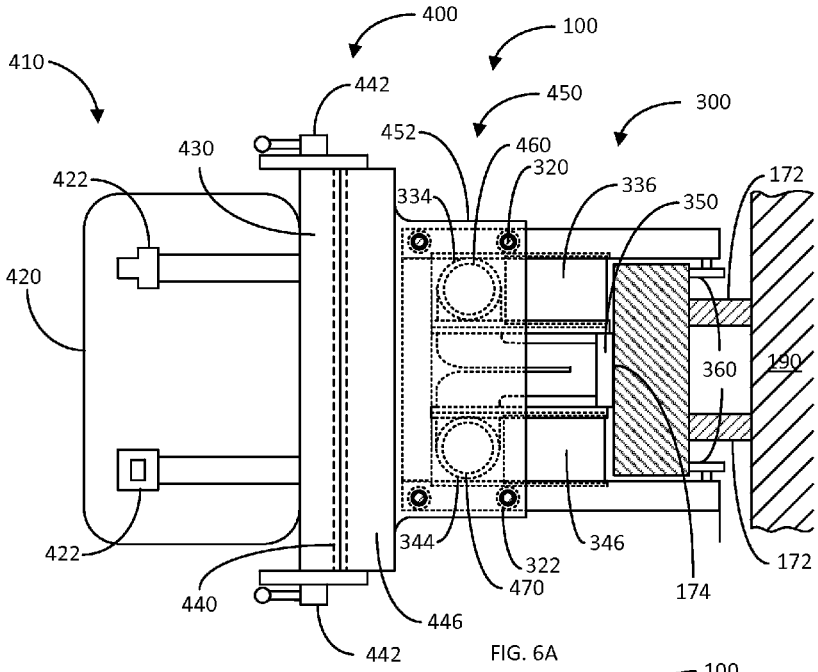
FIGS. 6A-6B illustrate top and side views of the exemplary apparatus for safely lowering a user from a structure in a first configuration in accordance with another aspect of the disclosure.
Figure 6B:
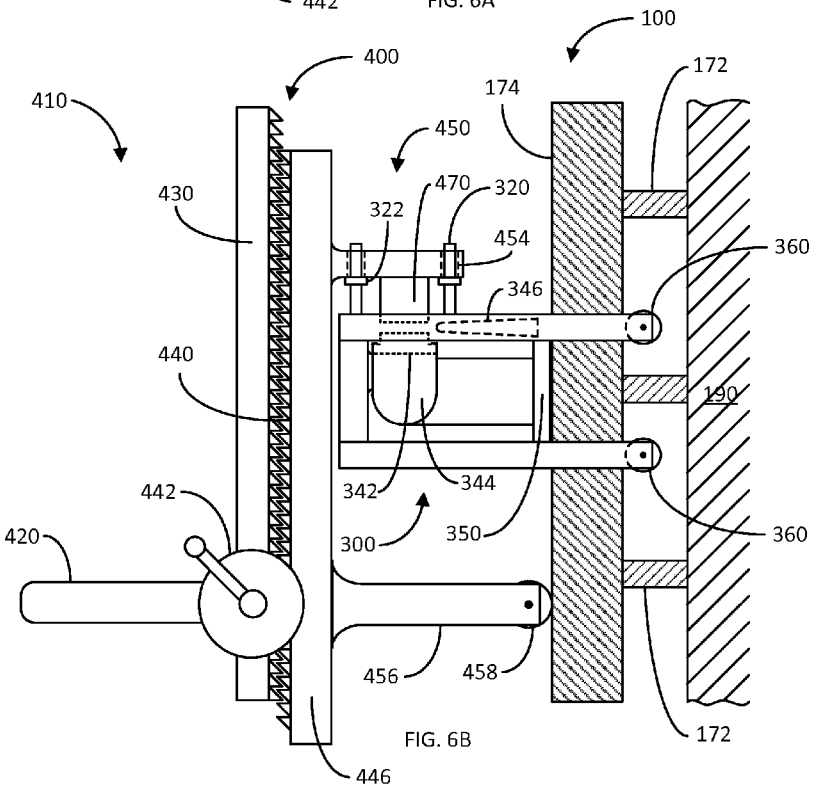

FIGS. 6A-6B illustrate top and side views of the exemplary apparatus 100 for safely lowering a user from the structure 190 in a first configuration in accordance with another aspect of the disclosure. In the first configuration, which may be present at the top vertical section of the track 170, the brake pad 350 is making relatively loose contact with the first vertical surface 174 of the track 170. Also, the wheels 360 are disposed on the rear surface of the track 170, and will roll along the rear surface while the apparatus 100 is descending. Further, the roller 458 is disposed on the first vertical surface 174, and will roll along the first vertical surface 174 while the apparatus 100 is descending.

In the first configuration, the first and second sliders 336 and 346 are in their respective first or deactivated positions due to the sections 176*a* and 178*a* of the second and third vertical surfaces of the track 170 not being substantially in contact with the sliders 336 and 346, respectively. In these positions, the first and second protrusions 460 and 470 are not coupled to the first and second pistons 332 and 342, respectively. Accordingly, the weight of the user support component 400 on the first and second pistons 332 and 334 is not transferred or coupled to the first and second hydraulic cylinders 334 and 344, respectively. Consequently, the first and second hydraulic brakes 330 and 340 exert substantially no pressure on the brake pad 350 against the first vertical surface 174 of the track 170. This allows the apparatus 100 to descend with a positive acceleration.

Figure 7A:
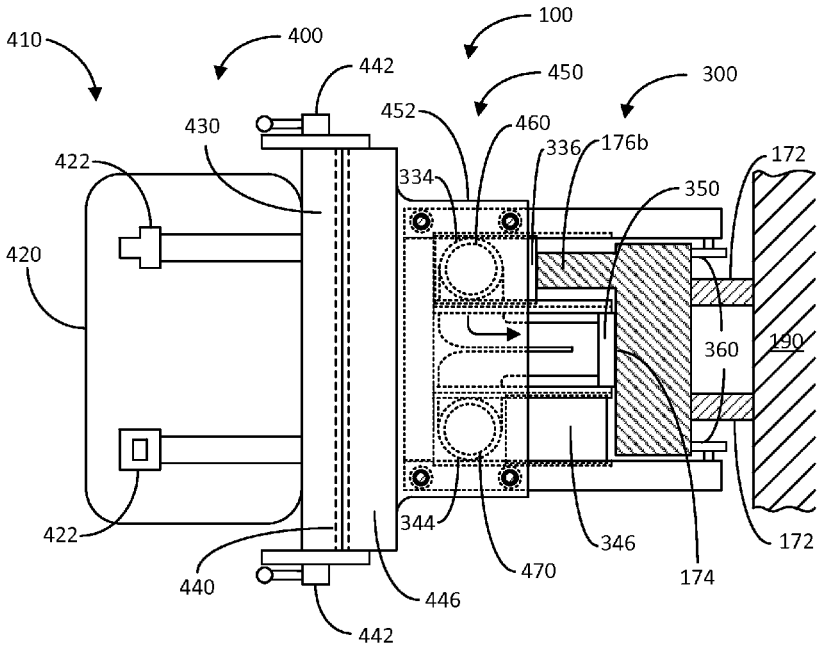
FIGS. 7A-7B illustrate top and side views of the exemplary apparatus for safely lowering a user from a structure in a second configuration in accordance with another aspect of the disclosure.
Figure 7B:
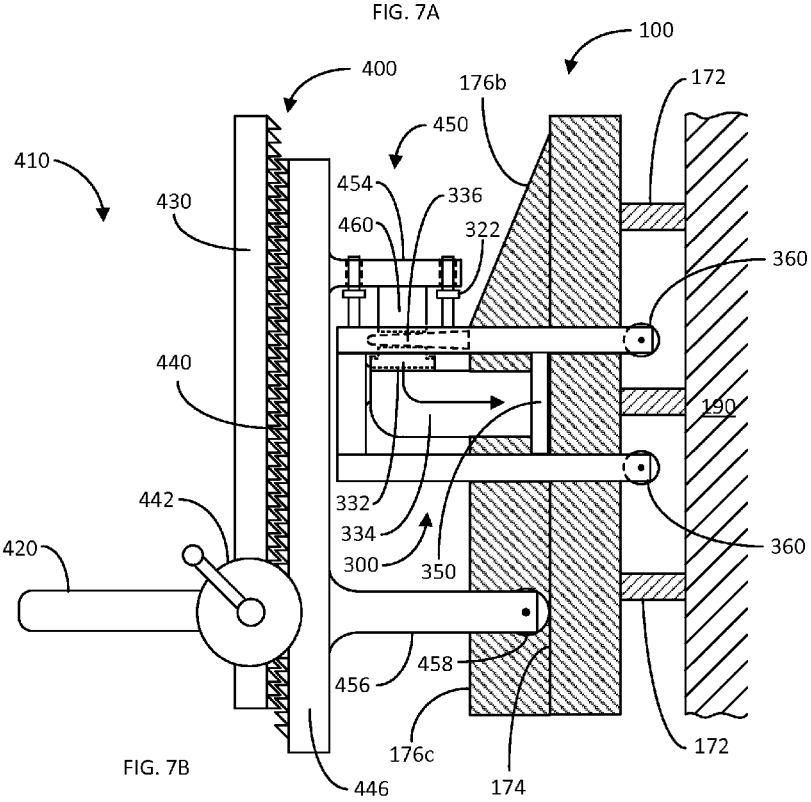

FIGS. 7A-7B illustrate top and side views of the exemplary apparatus 100 for safely lowering a user from the structure 190 in a second configuration in accordance with another aspect of the disclosure. Note that in FIG. 7B, the second piston 342 and second hydraulic cylinder 344 are removed to better illustrate the first piston 332 and the first hydraulic cylinder 334. In the second configuration, which may be present at the middle vertical section of the track 170, the first hydraulic brake 330 of the brake system 300 is activated, and thereby, applies a defined pressure on the brake pad 350 against the first vertical surface 174 of the track 170. This causes the apparatus 100 to descend along the middle vertical section of the track 170 at substantially constant velocity or with little to no acceleration. In the second configuration, the second hydraulic brake 340 is not activated.

More specifically, in the second configuration, the first slider 336 is moved to and maintained in the second or activated position by the ramped and vertical sections 176*b-c* of the second vertical surface of the track 170, respectively. In this position, the first slider 336 mechanically couples the first protrusion 460 to the first piston 332. Accordingly, the force applied by the protrusion 460 on the first piston 332 due to the weight of the user support component 400 on the brake system 300 is transferred or coupled to the fluid in the first hydraulic cylinder 334. Consequently, the first hydraulic brake 330 exerts a defined pressure on the brake pad 350 against the first vertical surface 174 of the track 170, as shown by the arrow. The increased pressure on the brake pad 350 against the first vertical surface 174 produces friction, thereby slowing the descent of the apparatus 100 so that it descends at substantially constant velocity.

Note that in the second configuration, the second slider 346 is in the first or deactivated position due to the section 178*a* of the third vertical surface of the track 170 not being substantially in contact with the second slider 346. As previously discussed, in this position, the second slider 346 does not couple the second protrusion 470 with the second piston 342. Consequently, in the second configuration, only the first hydraulic brake 330 exerts a defined pressure on the brake pad 350 against the first vertical surface 174 of the track 170, but not the second hydraulic brake 340. Again, this allows the apparatus 100 to descend at a substantially constant velocity. Note that the roller 458 continues to roll along the first vertical surface 174.

Figure 8A:
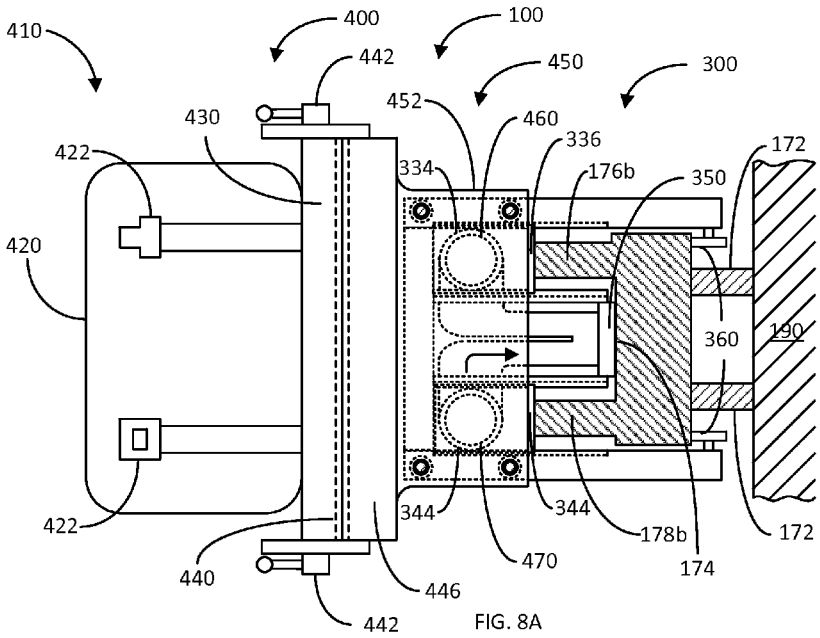
FIGS. 8A-8B illustrate top and side views of the exemplary apparatus for safely lowering a user from a structure in a third configuration in accordance with another aspect of the disclosure.
Figure 8B:
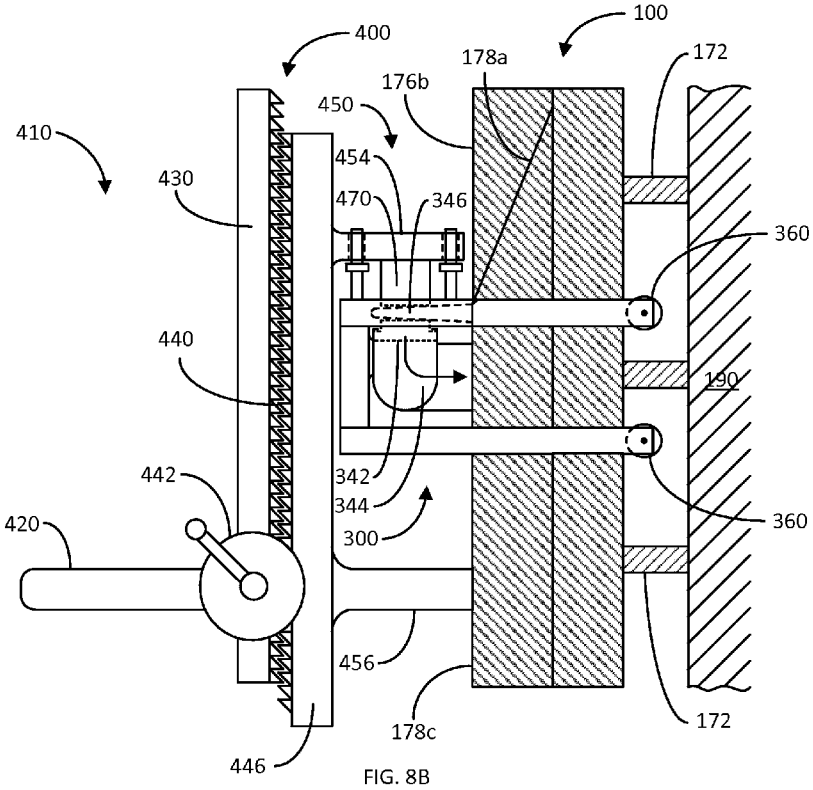

FIGS. 8A-8B illustrate top and side views of the exemplary apparatus 100 for safely lowering a user from the structure 190 in a third configuration in accordance with another aspect of the disclosure. In the third configuration, which may be present at the bottom vertical section of the track 170, only the second hydraulic brake 340 of the brake system 300 is activated, and thereby, applies a defined pressure on the brake pad 350 against the first vertical surface 174 of the track 170. The pressure applied by the second hydraulic brake 340 is greater than the pressure of the first hydraulic brake 330 because the second cylinder 344 has a cross-sectional area $A_2$ less than the cross-sectional area $A_1$ of the first cylinder 334. The increased pressure exerted by the second hydraulic brake 340 causes the apparatus 100 to descend along the bottom vertical section of the track 170 with a negative acceleration until the apparatus 100 lands on the stop component 180 of the track 170 near the ground or landing platform 195.

More specifically, in the third configuration, the second slider 346 is moved to and maintained in the second or activated position by the ramped and vertical sections 178*b-c* of the third vertical surface of the track 170, respectively. In this position, the second slider 346 mechanically couples the second protrusion 470 to the second piston 342. Accordingly, the force applied by the protrusion 470 against the second piston 342 due to the weight of the user support component 400 on the brake system 300 is transferred or coupled to the fluid in the second hydraulic cylinder 344. Because the thickness $T_2$ of the second slider 346 is greater than the thickness $T_1$ of the first slider 336, the second slider 346 moving into the activated position raises the user support component 400 higher, and effectively decouples the first protrusion 460 from the first slider 336. Accordingly, the pressure exerted by the first hydraulic brake 330 is substantially reduced.

Consequently, the higher pressure exerted by the second hydraulic brake 340 is applied to the brake pad 350, as shown by the arrow. The increased pressure on the brake pad 350 against the first vertical surface 174 produces additional friction, thereby causing the apparatus 100 to descend with a negative acceleration until the bottom of the vertical member 446 of the user support component 410 lands on the stop component 180 of the track 170. In this position, the user may safely disembark from the apparatus 100 onto the ground or landing platform 195. Additionally, the user, or other person assisting the user, may remove the apparatus 100 away from the landing area to avoid a collision between the apparatus 100 and a following apparatus descending via the track.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for safely lowering a user from a structure, said apparatus comprising:

a user support component configured to support the user; and a brake system coupled to the user support component and a vertical track, wherein the vertical track has a top, a bottom, a first surface and a second surface, and wherein the brake system comprises:

a brake pad configured to make frictional contact to the first surface of the track situated proximate the structure; and a first hydraulic brake configured to apply a first defined pressure on the brake pad against the first surface of the track; and a second hydraulic brake configured to apply a second defined pressure on the brake pad against the first surface of the track; and wherein the second surface of the track is configured to activate the first hydraulic brake to apply the first defined pressure on the brake pad against the first surface of the track, the second surface of the track is configured to activate the first hydraulic brake at a first defined distance located below the top of the track, the second surface of the track is further configured to maintain the activation of the first hydraulic brake from proximate the first defined distance located below the top of the track to substantially the bottom of the track, wherein the second surface comprises:

a first section situated above the first defined distance located below the top of the track, wherein the first section is configured to not activate the first hydraulic brake; and a second section situated proximately at the first defined distance located below the top of the track, wherein the second section is configured to activate the first hydraulic brake; and a third section extending from the first defined distance to substantially the bottom of the track, wherein the third section is configured to maintain the activation of the first hydraulic brake; and the first hydraulic brake comprises:

a hydraulic cylinder; and a piston configured to exert pressure on fluid contained in the hydraulic cylinder; and a slider configured to couple a portion of the user support component to the piston when the first hydraulic brake is activated, wherein:

the first section of the second surface of the track is configured not to move the slider from a first position to a second position, wherein the slider does not couple the portion of the user support component to the piston in the first position;

the second section of the second surface of the track is configured to move the slider from the first position to the second position to cause the slider to couple the portion of the user support component to the piston to apply the first defined pressure; and the third section of the second surface of the track is configured to maintain the slider in the second position.

2. The apparatus of claim 1, wherein the portion of the user support component is configured to apply a force on the piston, wherein the force is transferred by way of the slider to the piston to the hydraulic cylinder to form the first defined pressure on the brake pad.

3. The apparatus of claim 1, wherein the track comprises a third surface of the track configured to activate the second hydraulic brake to apply the second defined pressure on the brake pad against the first surface of the track.

4. The apparatus of claim 3, wherein the third surface of the track is configured to activate the second hydraulic brake at a second defined distance below the top of the track.

5. The apparatus of claim 4, wherein the third surface of the track is further configured to maintain the activation of the second hydraulic brake from proximate the second defined distance below the top of the track to substantially the bottom of the track.

6. The apparatus of claim 5, wherein the third surface comprises:

a first section situated above the second defined distance below the top of the track, wherein the first section of the third surface is configured to not activate the second hydraulic brake;

a second section situated proximate the second defined distance below the top of the track, wherein the second section of the third surface is configured to activate the second hydraulic brake; and a third section extending from the second defined distance to substantially the bottom of the track, wherein the third section of the third surface is configured to maintain the activation of the second hydraulic brake.

7. The apparatus of claim 6, wherein the second hydraulic brake comprises:

a hydraulic cylinder;

a piston configured to exert pressure on fluid contained in the hydraulic cylinder of the second hydraulic brake; and a slider configured to couple a second portion of the user support component to the piston of the second hydraulic brake when the second hydraulic brake is activated.

8. The apparatus of claim 7, wherein:

the first section of the third surface of the track is configured not to move the slider from a first position to a second position, wherein the slider of the second hydraulic brake does not couple the portion of the user support component to the piston of the second hydraulic brake in the first position of the second hydraulic brake;

the second section of the third surface of the track is configured to move the slider of the second hydraulic brake from the first position of the second hydraulic brake to the second position of the second hydraulic brake to cause the slider of the second hydraulic brake to couple the second portion of the user support component to the piston of the second hydraulic brake; and the third section of the third surface of the track is configured to maintain the slider of the second hydraulic brake in the second position of the second hydraulic brake.

9. The apparatus of claim 8, wherein the second portion of the user support component is configured to apply a force on the piston of the second hydraulic brake, wherein the force of the second hydraulic brake is transferred by way of the slider of the second hydraulic brake to the piston of the second hydraulic brake to form the second defined pressure on the brake pad.

10. The apparatus of claim 1, wherein the brake system comprises a plurality of wheels configured to roll on the track.

11. The apparatus of claim 1, wherein:

an upper vertical section of the track is configured not to activate the first and second hydraulic brakes to allow the apparatus to descend with a positive acceleration;

a middle vertical section of the track is configured to activate the first hydraulic brake but not the second hydraulic brake to allow the apparatus to descend with a substantially constant velocity; and a lower vertical section of the track is configured to activate the second hydraulic brake but not the first hydraulic brake to allow the apparatus to descend with a negative acceleration.

12. The apparatus of claim 11, wherein the track comprises a stop component situated at a bottom of the lower vertical section of the track, wherein the stop component is configured to stop the apparatus from descending beyond the stop component.

13. A method of lowering a user from a structure, said method comprising:

providing the apparatus of claim 1; and applying substantially no pressure on the brake pad against the track situated proximate the structure to allow the user support component to descend with a positive acceleration for the first defined distance;

applying the first defined pressure on the brake pad against the track to allow the user support component to descend with a substantially constant velocity for a second defined distance; and applying the second defined pressure on the brake pad against the track to allow the user support component to descend with a negative acceleration for a third defined distance.

* * * * *